US005470132A

United States Patent [19]

Cartwright

[11] Patent Number: 5,470,132

[45] Date of Patent: Nov. 28, 1995

[54] TUNNELLING HEAD AND METHOD

[76] Inventor: Dewight L. Cartwright, 147 Caversham Woods, Pittsford, N.Y. 14534

[21] Appl. No.: 280,937

[22] Filed: Jul. 27, 1994

[51] Int. Cl.[6] ..... E21D 9/08

[52] U.S. Cl. ..... 299/56; 299/68; 405/143

[58] Field of Search ..... 299/31, 33, 55, 299/56, 68, 90, 87, 18; 175/62; 405/138, 141, 143

[56] References Cited

U.S. PATENT DOCUMENTS

| | | | |
|---|---|---|---|
| 2,756,037 | 7/1956 | Kirkpatrick | 299/55 X |
| 4,629,255 | 12/1986 | Babendererde | 299/68 X |
| 4,655,493 | 4/1987 | Sumi | 299/31 X |
| 5,072,992 | 12/1991 | Gurbunov et al. | 299/56 X |

FOREIGN PATENT DOCUMENTS

| | | | |
|---|---|---|---|
| 3537593 | 9/1986 | Germany | 299/56 |

*Primary Examiner*—David J. Bagnell
*Attorney, Agent, or Firm*—Ralph Bailey

[57] ABSTRACT

A micro tunnelling head and earth boring method is illustrated which includes utilizing a cutting head (G) spaced forwardly of a cylindrical articulated housing (A) having a transverse bulkhead (B) intermediate its ends for carrying a centrally disposed tube (C) carrying a driven auger (F) for operating the cutting head and removing the spoil inwardly from the housing through a chamber (D) which receives cuttings through a passageway (E) provided therein. Steering mechanism includes circumferentially spaced fluid operated cylinder assemblies (I) for pivotal fixation on adjacent ends of the articulated connection between the cylindrical housing (A) and a forward end of a casing for facilitating steering.

24 Claims, 4 Drawing Sheets

TUNNELLING HEAD AND METHOD

BACKGROUND OF THE INVENTION

This invention relates to an improved micro tunnelling head and method of horizontal earth boring utilizing an improved cutting head drive combined with apparatus for removing cuttings with provisions for improved steering of an articulated housing carrying the cutting head for rotation.

Micro tunnelling heads in present use commonly utilize a centrally disposed power take off drive for the cutting head together with a separate belt conveyor or separate auger conveyor receiving cuttings at the bottom of an enlarged chamber receiving cuttings from the cutting head. Such apparatus is complicated and expensive. Furthermore, boring apparatus constructed in this fashion results in a compartment for workers accessing the head. Horizontal earth boring machines of this type are include those manufactured by American Augers, Inc. of Wooster, Ohio. Another supplier of tunnelling equipment, Neil H. Akkerman, utilizes a ring gear drive for the cutting head together with a separate conveyor for removing cuttings. Such apparatus constructed in accordance with the prior art is not only complicated and expensive but also is extremely difficult to steer because of the fact that the steering apparatus provides articulation at a substantial distance rearwardly of the cutting head.

An earth boring apparatus with a steering head is illustrated in U.S. Pat. No. 4,977,967 having a housing which is hingedly attached to a casing, the housing being positioned immediately behind the cutting head. Steering adjustments are made by manipulating a tube which also supplies lubricant such as driller's mud to the cutting head. A disadvantage of such apparatus resides in the fact that the auger which is centrally disposed and drives the cutting head is coextensive with the casing so as to limit the length of the drive and spoil delivery system.

A drive employing a hex connection is illustrated in U.S. Pat. No. 4,632,195, but is not adapted to articulation as is the drive effected by the hex connection to the auger shaft of the present invention.

Also note the difference to U.S. Pat. Nos. 4,630,967; 4,684,290; and 4,763,954.

SUMMARY OF THE INVENTION

Accordingly, it is an important object of this invention to provide an improved micro tunnelling head which is of simple construction and capable of operating over extended distances while facilitating steering through the use of remotely controlled circumferentially spaced fluid operated cylinder assemblies.

Another important object of the invention is the provision of a centrally disposed auger which supplies the driving force for the cutting head and which extends into a chamber immediately behind the cutting head for receiving the cuttings and transporting them rearwardly. By making the auger and its tube serve the function of a drive means as well as a receptacle for receiving cuttings which are delivered rearwardly from the chamber which is positioned forwardly of a transverse bulkhead. An effective construction is achieved which provides easier access in and to the MTBM head.

Another significant object of the invention is achieved through the provision of circumferentially spaced fluid operated cylinder assemblies for selectively exerting force as a result of external manipulation upon a cylindrical housing positioned forwardly of the point at which articulation occurs between the cylindrical housing and a casing.

Another important object of the invention is the provision of a micro tunnelling head having a cylindrical housing divided into forward and rearward sections by a transverse bulkhead wherein a chamber extends forwardly of the bulkhead for receiving cuttings from the cutting head for transporting them rearwardly by an auger carried in a central section of the casing.

Another important object of the invention is accomplished by the provision of paddles carried by the cutting head for delivering cuttings into a chamber positioned axially and forwardly of a transverse intermediate bulkhead.

Still another important object of the invention is the provision of a plurality of doors in the bulkhead so that access may be had to obstacles such as boulders in order to remove or otherwise dispose of such obstacles. This also allows through control of the bulkheads a method of achieving earth balance of the MTBH face.

Since the transport means for the cuttings is centrally disposed serving as a drive for the cutting head and occupies only a portion of the micro tunnelling head and adjoining casing, the inertia of drive as well as the transport mechanism may be executed effectively over extended distances through inexpensive, simplified construction techniques.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

The drawings illustrate a micro tunneling head, for use with the usual earth boring apparatus, having a substantially cylindrical housing A. A bulkhead B extends transversely across and is fixed to the housing forming a zone for receiving cuttings during boring forwardly thereof. An elongated axially disposed cylindrical tube C has a forward end connected to the bulkhead opposite a central opening in the bulkhead. A chamber D is positioned opposite and opens into the cylindrical tube through the opening in the bulkhead. An access passageway E is provided in the chamber for delivering cuttings from said zone into the chamber. An auger F within the cylindrical tube extends into the chamber for transporting the cuttings from the chamber rearwardly into the tube. A cutting head G is carried forwardly of the housing for rotation about a central axis. Spaced paddles H extend inwardly from the cutting head carrying cuttings through passageway into the cylindrical chamber.

The drawings further illustrate steering apparatus including a plurality of circumferentially spaced fluid operated cylinder assemblies I each connected on one end to the cylindrical housing radially of and in substantial alignment with the cylindrical tube. An articulated connection is provided between the cylindrical housing and a casing section aligned with the housing to which the other ends of the cylinder assemblies are connected.

Figure 1:
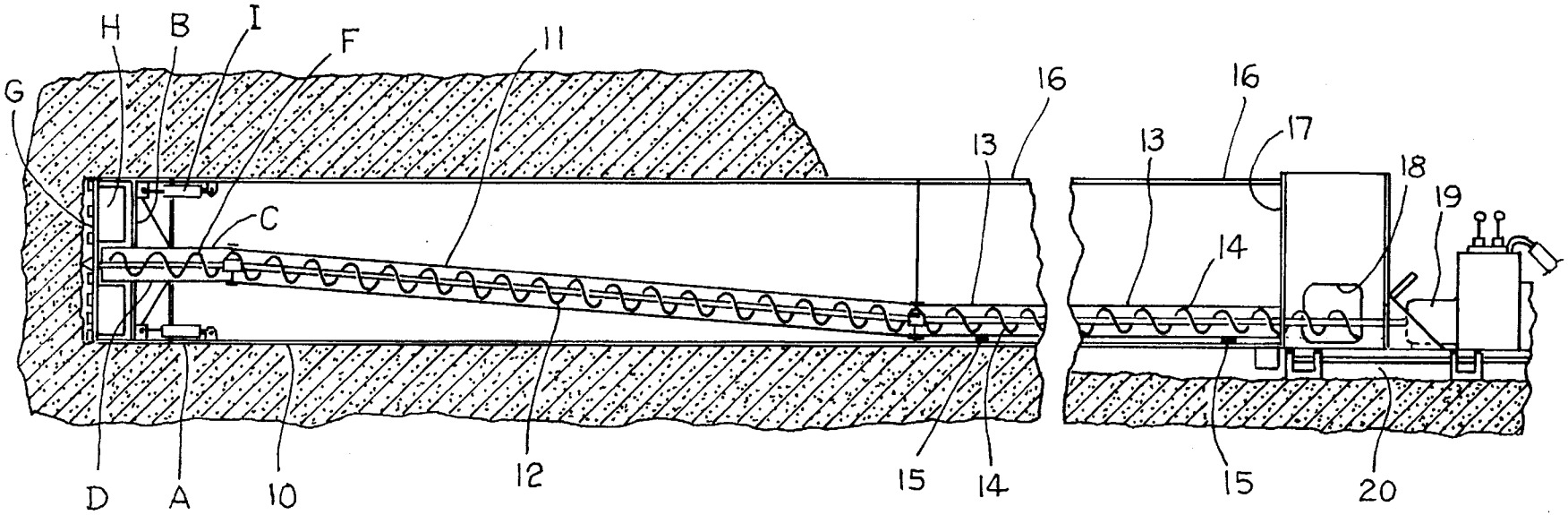
FIG. 1 is a longitudinal sectional elevation illustrating a micro tunnelling head constructed in accordance with the invention with central drive and conveyor system utilizing an articulated remotely controlled cylindrical housing for steering in use with the usual apparatus for exerting a horizontal force upon a casing for pushing the micro tunnelling head forwardly and for driving the auger for removing the cuttings in such a way as to also serve as a power operated means for driving the cutting head with circumferentially spaced fluid operated cylinder assemblies affixed forwardly of a point at which the cutting head has an articulated connection with a casing for providing a simplified and effective steering apparatus which is quick to respond and conveniently manipulated by personnel.

The substantial cylindrical rigid metallic housing A is illustrated in FIG. 1 as being axially mounted upon the forward end of a horizontal longitudinal casing section 10. The bulkhead B is also rigid and extends transversely across the housing in a substantially vertical plane and forms a zone receiving cuttings during boring forwardly of the bulkhead. The bulkhead is welded to the housing thereabout. The elongated axially disposed cylindrical metallic rigid tube C has an articulated connection with a downwardly inclined tubular section 11 which carries an auger 12 therein. The cylindrical tube 11 and auger 12 are inclined downwardly for joining succeeding tubular sections 13 which carry augers 14. The tubular sections 13 are preferably carried upon wooden blocks 15. Thus, the spoil is conveyed rearwardly through the tubular sections 13 carried at the bottom of succeeding casing sections 16. The last of the casing sections is pushed forwardly by means of the usual push ring 17 which has a side delivery opening 18 for expelling the spoil transported rearwardly by the auger 14. A suitable power operated drive 19 is provided imparting a rotary drive to the auger 14. The pushing and driving apparatuses are illustrated as being carried upon the usual rails 20 for forward movement thereon.

Figure 2:
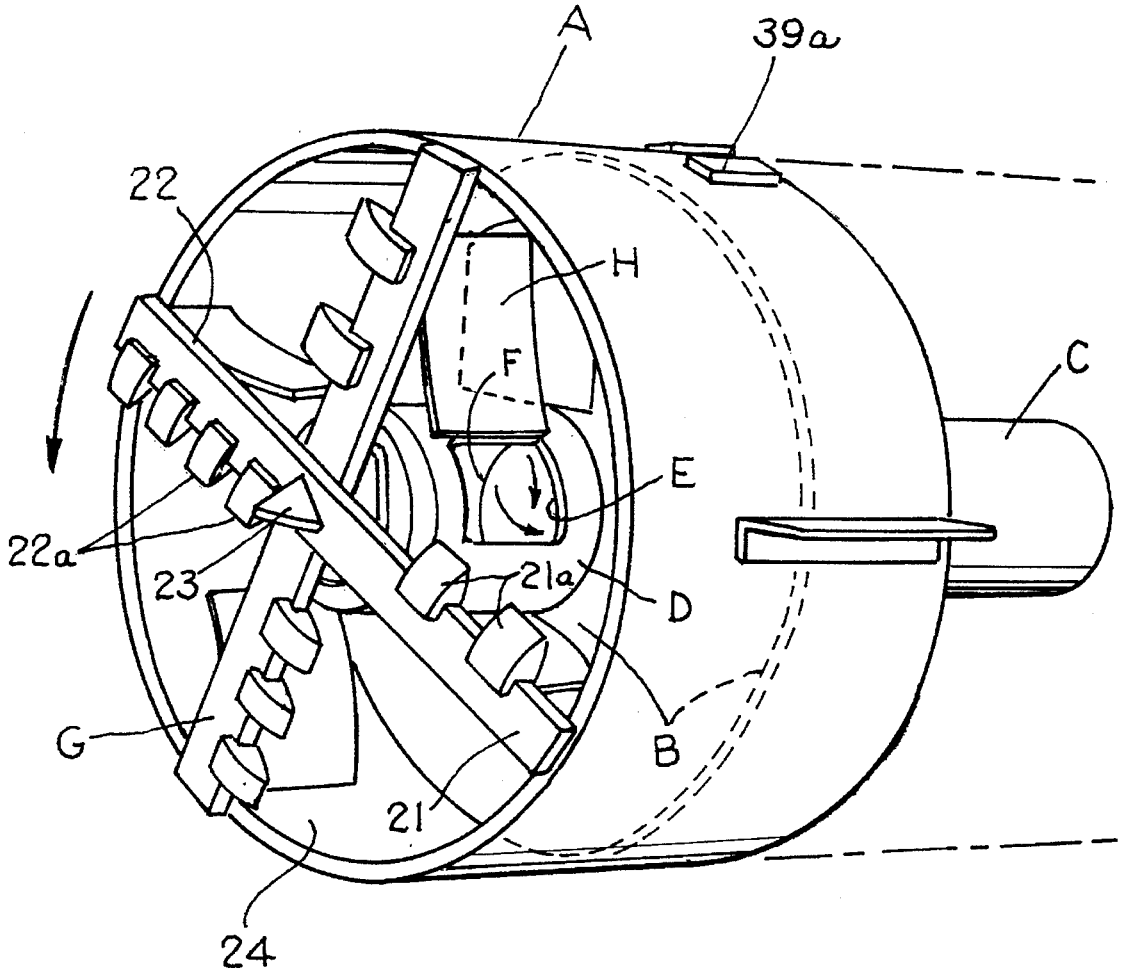
FIG. 2 is an enlarged perspective view looking from the front and right side of a cutting head constructed in accordance with the present invention wherein a cylindrical housing has a transverse bulkhead intermediate its ends providing a chamber for receiving cuttings forwardly thereof with a central drive.

FIG. 2 is an enlarged perspective view showing crossed bars 21 and 22 welded at the center for carrying spaced teeth 21*a* and 22*a* respectively. The usual center bit is illustrated at 23 on the cutting head. The cutting head is spaced forwardly from a forward edge of the cylindrical housing A thus forming a zone 24 for receiving cuttings and delivering them to the section of the housing A which extends forwardly of the bulkhead B. The bars 21 and 22 forming the cutting head carry circumferentially spaced paddles H which extend inwardly from the bars 21 and 22 toward the bulkhead B and radially inwardly toward the chamber D in order to gather up the cuttings from the cutting head during the boring operation for delivering them to the chamber D which is positioned axially centrally of the housing A. The chamber D has an access passageway E therein for delivery cuttings from the zone 24 by way of the paddles into the chamber where a forward portion of the auger F transports the cuttings rearwardly through the elongated cylindrical tube C.

If desired, the paddles may be of abbreviated size and of varied configurations depending upon the type of material at the tunnelling head for boring. In some instances such as where the soil is fluid or sandy, the paddles may be omitted all together provided the force exerted by the push ring 17 is sufficient to advance the cutting head facilitating reception of the cuttings into the chamber D.

Figure 3:
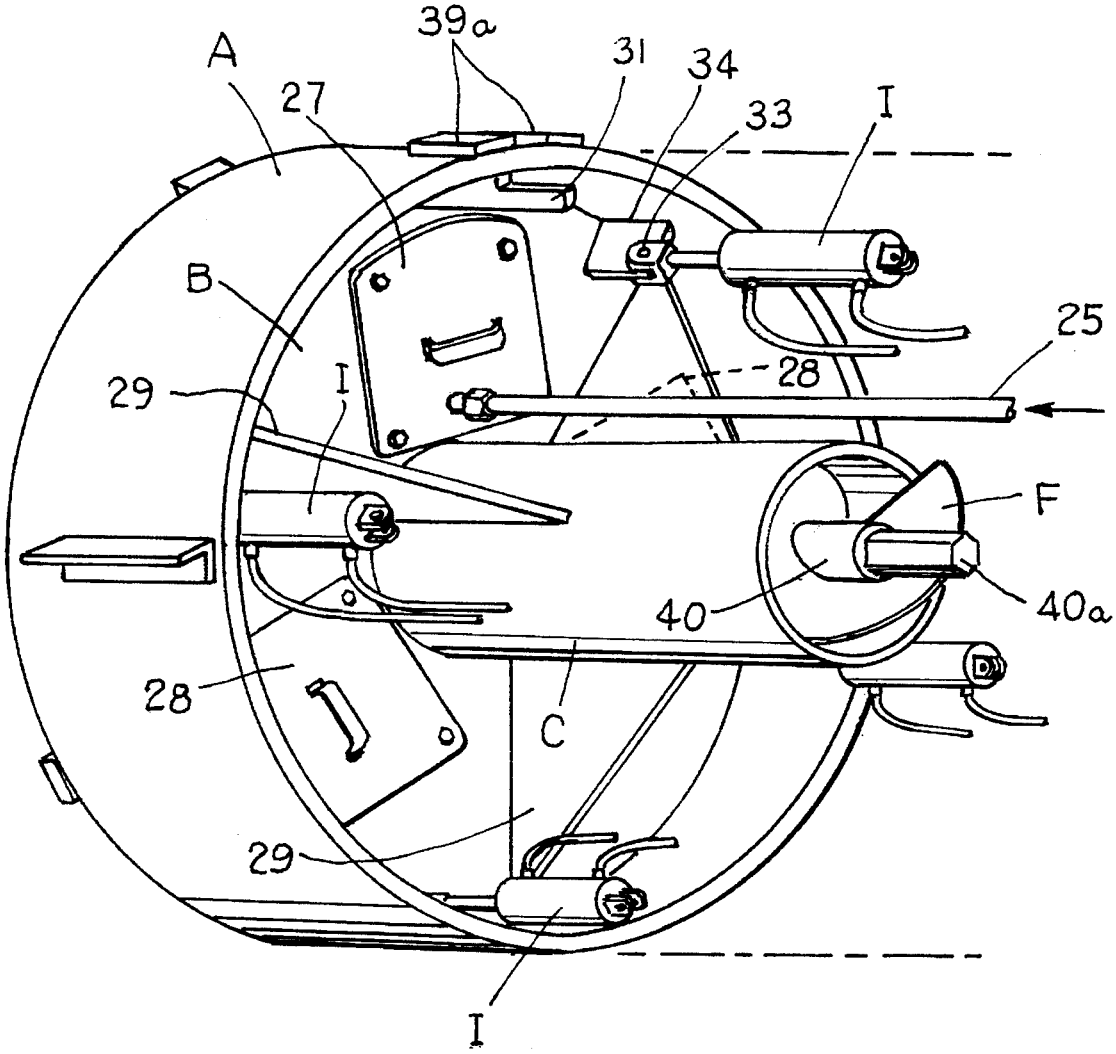
FIG. 3 is a perspective view looking toward the rear of the tunnelling head illustrated in FIG. 3 illustrating the circumferentially spaced fluid operated steering assemblies together with the auger drive and disposal system with circumferentially spaced doors for conveniently accessing obstructions to the advancement of the tunnelling head during an earth boring operation.

In this connection, it will be observed in FIG. 3 that a pressurized source of bentonite or driller's mud is provided through the pressurized hose 25 into which the driller's mud is pumped from a suitable supply (not shown). The hose has a connection to a fitting 26 carried in a removable door 27 positioned in the bulkhead B for delivery to the cutting head for mixing with the cuttings forwardly thereof. Additional circumferentially spaced access doors are illustrated at 28 for convenient access to the cutting head. It will be observed that the axially disposed cylindrical tube C has a fixed connection with the bulkhead B at a forward end and is suitably reinforced by the circumferentially spaced gusset plates 29.

Figure 4:
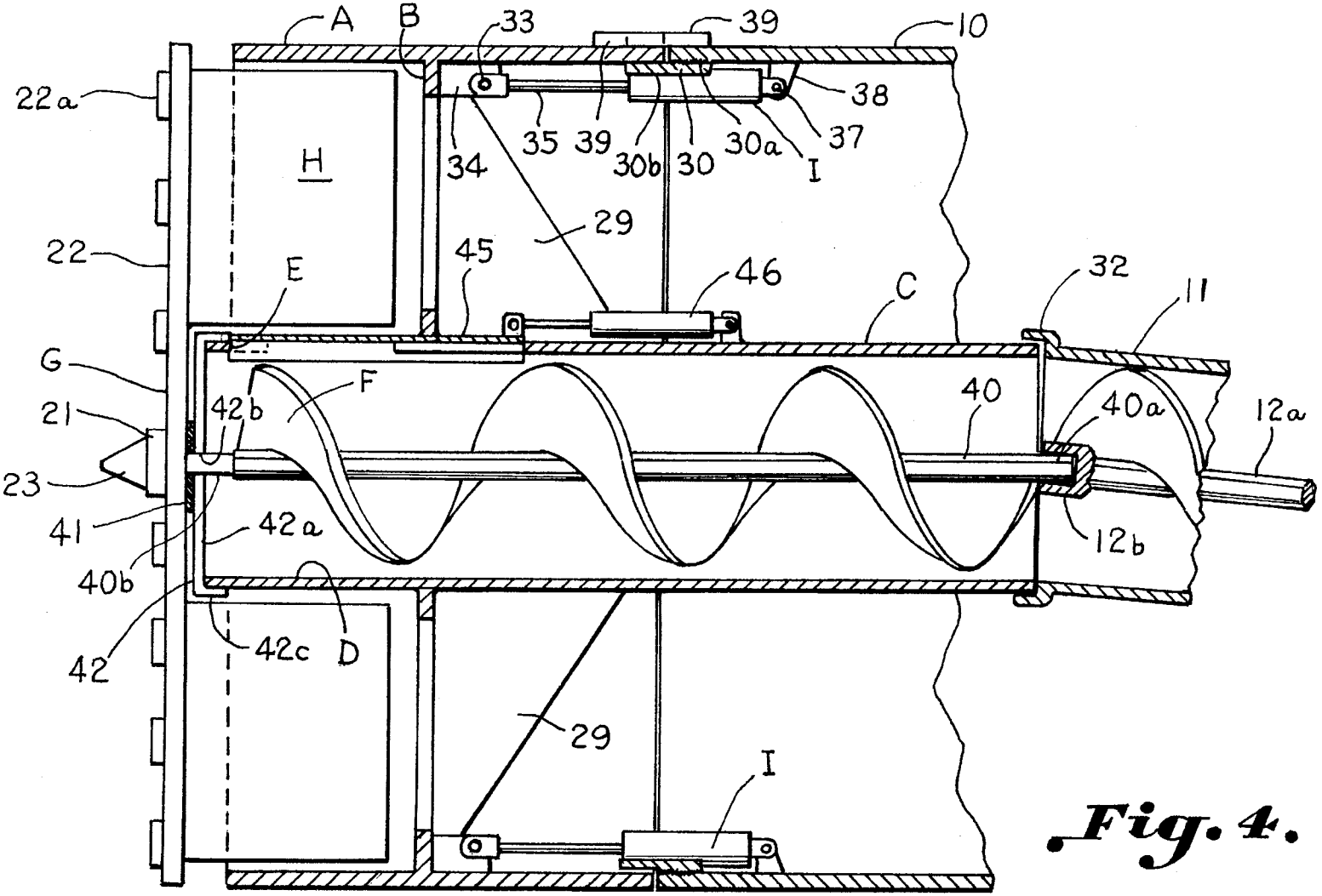
FIG. 4 is an enlarged longitudinal sectional elevation illustrating the auger drive and collection system together with the circumferentially spaced fluid operated cylinder assemblies for effecting steering together with a modified form of the invention in that a door with a fluid operated cylinder assembly is provided for closing the access opening or passageway to the chamber carried forwardly of the bulkhead for receiving cuttings so that cuttings will not continue to enter the chamber when the auger drive is discontinued to avoid clogging the auger.

Referring to FIGS. 1 and 4, it will be noted that the chamber D may be formed as by an integral extension of the tube C within the forward section of the housing forwardly of the bulkhead B. Referring more particularly to FIGS. 3 and 4, articulated connections are illustrated between the cylindrical housing A and the forward end of a casing 10 and between the axially disposed cylindrically disposed tube C and the forward end of the downwardly inclined tubular section 11. The forward end of the casing 10 has a weld ring 30 fixed to the inside of the casing 10 as by welding at 30*a*. A forwardly end of the weld ring 30*b* extends forwardly and is received for adjustable movement within a receiving guide member 31 which has fixed connection with an inner portion of the cylindrical housing A adjacent an inner edge for adjustably receiving the forward projection 30*b* of the weld ring 30. The forward end of the downwardly inclined tubular section 11 has a similar weld ring 32 but it extends forwardly of the outside diameter of the tubular section 11 for adjustably receiving the adjacent end of the tubular section C. If desired, the articulated connections between the cylindrical housing A and the casing 10 as well as the articulated drive between the tubular sections may be O-ringed, pressurized with air or otherwise sealed.

Still referring to FIGS. 3 and 4, it will be observed that the circumferentially spaced fluid operated cylindrical assemblies I each have pivotal connection on one end as at 33 to a lug 34 carried by the bulkhead B adjacent an inner diameter of the cylindrical housing A. An extensible member 35 is carried within the cylinder 36 which has pivotal connection as at 37 to a lug 38 carried adjacent a forward end of the inner diameter of the casing 10. An alignment block 39 carried by a forward end of the casing 10 extends outwardly and between special alignment blocks 39*a* carried by the cylindrical housing A affording longitudinal and circumferential alignment.

An articulated drive for the augers and cutting head driven thereby is achieved through a hex connection between a drive bar 12*a* having a hexagonal socket 12*b* for receiving the bar 40 having a hexagonal end 40*a*. The hexagonal bar 40 extends forwardly into the chamber D for driving the cutting head G as by a welded connection 41 to the bar 40 as at the extension 40*b* thereof.

The chamber D has a cutting head centering ring and slurry plug illustrated at 42. The vertical web 42*a* has a hexagonal opening 42*b* for fixed connection with the shaft extension 40*b*. The inwardly directed peripheral flange 42*c* is thus carried for rotation about the forward circumference of chamber D. Thus, the cylindrical housing supports the cutting head for rotation.

Referring to FIG. 4, a modified form of the invention is illustrated as including a sliding door 45 which is operated by the fluid operated cylinder assembly 46 for closing the passageway E within the chamber D during periods of cessation of the drilling operation to avoid ground subsidence, voids or clogging of the auger drive mechanism as may result from a continued entry of cuttings. It is important to note that in the event of a cave-in of sandy soil that the door 45 may be closed to run with a slurry only so as to build a supporting bore to receive the casing inserted therein.

It is thus seen that an improved tunnelling head and method of micro tunnelling have been provided wherein the cutting head drive and spoil removal are effected by a centrally disposed auger together with the provision of a chamber for receiving the cuttings as a slurry for delivery rearwardly by the auger. A simplified steering apparatus includes the circumferentially spaced remotely operated spaced cylinder assemblies which are positioned forwardly adjacent an articulated connection between the cylindrical housing and the forward end of a casing. A transverse intermediately positioned bulkhead is provided with doors which may be circumferentially spaced for affording easy access to obstacles encountered during the drilling operation for suitable disposal.

While a preferred embodiment of the invention has been described using specific terms, such description is for illustrative purposes only, and it is to be understood that changes and variations may be made without departing from the spirit or scope of the following claims.

What is claimed is:

1. A tunneling head for use with earth boring apparatus comprising:

a substantially cylindrical housing;

a bulkhead extending transversely across said housing forming a zone forwardly thereof for receiving cuttings during boring;

means receiving said bulkhead in fixed relation thereabout to an interior of said housing;

an elongated axially disposed cylindrical tube having a forward end received by said bulkhead opposite an opening in said bulkhead;

means fixing said forward end of said tube to said bulkhead;

a chamber opposite and opening into said cylindrical tube through said opening in said bulkhead;

an access passageway in said chamber for delivering cuttings from said zone into the chamber;

an auger within said cylindrical tube extending into said chamber for transporting said cuttings from said chamber rearwardly into said tube; and a cutting head carried forwardly of said housing for rotation about a central axis.

2. The structure set forth in claim 1 wherein said bulkhead is fixed to an interior portion of said housing providing sufficient depth at the front of the tunnelling head to accommodate said chamber.

3. The structure set forth in claim 2 including a plurality of circumferentially spaced steering cylinder assemblies each connected on one end to said cylindrical housing radially of and in substantial alignment with said cylindrical tube; a casing section aligned with said housing to which the other ends of the cylinder assemblies are connected; and an articulated connection between said cylindrical housing and said casing section permitting steering of said boring head responsive to actuation of respective cylinder assemblies.

4. The structure set forth in claim 3 wherein said articulated connection includes a cylindrical band carried at a forward end of said casing in alignment with said housing forming a joint affording limited adjustment in longitudinal alignment between said housing and said casing for effecting steering of said boring head.

5. The structure set forth in claim 4 wherein said cylindrical band is welded to said forward end of said casing and is receivable within said cylindrical housing.

6. The structure set forth in claim 3 wherein said auger extends rearwardly terminating adjacent an end of said tube.

7. The structure set forth in claim 6 including a connection on said auger adjacent said end of said tube providing an articulated drive for said auger; and an adjoining tube section forming a joint with said end of said tube affording limited adjustment in longitudinal alignment therebetween.

8. The structure set forth in claim 3 including alignment blocks extending between said housing and said adjacent end of said casing.

9. The structure set forth in claim 2 wherein said bulkhead is fixed intermediate the ends of said housing; and including at least one door in said bulkhead.

10. The structure set forth in claim 2 wherein said cylindrical tube extends through said bulkhead forming said chamber, and has spaced reinforcing flanges connecting it to said bulkhead.

11. The structure set forth in claim 13 wherein said paddles extending inwardly from said cutting head carrying cuttings through said passageway into said chamber.

12. The structure set forth in claim 11 wherein said paddles extend rearwardly and are contained within said cylindrical housing opposite said access passageway and extend radially inwardly forming said cutting head toward said access passageway.

13. The structure set forth in claim 1 wherein a forward end of said auger has a driving connection with said cutting head.

14. The structure set forth in claim 13 wherein said cutting head includes a plurality of circumferentially spaced bars extending radially outwardly from said driving connection.

15. The structure set forth in claim 13 wherein said driving connection includes a drive bar on said auger extending axially rearwardly to said driving connection for said auger.

16. The structure set forth in claim 15 wherein said articulated drive for said auger includes a hex head and hex socket connection at said drive bar adjacent said joint between tube and an adjoining tube section with an adjoining drive bar, said connection affording limited adjustment in longitudinal alignment therebetween.

17. The structure set forth in claim 13 including a circumferential ring centering said driving connection and sealing said tube against entry of cuttings thereabout.

18. The structure set forth in claim 1 including a slidable closure for said access passageway; a cylinder assembly carried by said tube on a side of said bulkhead remote from said access passageway for operating said slidable closure, and a source of driller's mud for introduction to said cutting head.

19. The method of micro tunnelling including the steps of:

removing cuttings utilizing a cutting head mounted forwardly of a cylindrical housing;

providing a stationary bulkhead extending across said cylindrical housing;

discharging said cuttings into a stationary chamber mounted axially in said cylindrical housing forwardly of said stationary bulkhead; and removing cuttings from said cylindrical housing and driving said cutting head utilizing an auger extending axially from said cylindrical housing rearwardly and thence through a casing carried in fixed relation to said housing.

20. The method of micro tunnelling set forth in claim 19 including the steps of providing driller's mud to said cutting head and closing said cylindrical housing to the reception of cuttings.

21. The method of micro tunnelling set forth in claim 19 including the steps of providing an articulated joint between said cylindrical housing and said casing; and exerting circumferentially spaced forces between said casing and said housing for steering said housing and cutting head.

22. The method of micro tunnelling set forth in claim 21 including providing an auger drive bar extending from said cutting head rearwardly through said casing to an articulated drive connection.

23. A tunnelling head for use with earth boring apparatus comprising:

a substantially cylindrical housing:

a bulkhead extending substantially vertically transversely across and fixed to said housing forming a zone forwardly thereof for receiving cuttings during boring;

an elongated axially disposed cylindrical tube having a forward end connected to said bulkhead opposite an opening in said bulkhead;

a chamber opposite and opening into said cylindrical tube through said opening in said bulkhead;

said bulkhead is fixed to an interior portion of said housing providing sufficient depth at the front of the tunnelling head to accommodate said chamber;

an access passageway in said chamber for delivering cuttings from said zone into the chamber;

an auger within said cylindrical tube extending into said chamber for transporting said cuttings from said chamber rearwardly into said tube;

a cutting head carried forwardly of said housing for rotation about a central axis;

a plurality of circumferentially spaced steering cylinder assemblies each connected on one end to said cylindrical housing radially of and in substantial alignment with said cylindrical tube;

a casing section aligned with said housing to which the other ends of the cylinder assemblies are connected; and am articulated connection between said cylindrical housing and said casing section permitting steering of said boring head responsive to actuation of respective cylinder assemblies.

24. A tunneling head for use with earth boring apparatus comprising:

a substantially cylindrical housing;

a bulkhead extending substantially vertically transversely across and fixed to said housing intermediate the ends of said housing forming a zone forwardly thereof for receiving cuttings during boring;

at least one door in said bulkhead;

an elongated axially disposed cylindrical tube having a forward end connected to said bulkhead opposite an opening in said bulkhead;

a chamber opposite and opening into said cylindrical tube through said opening in said bulkhead;

an access passageway in said chamber for delivering cuttings from said zone into the chamber;

an auger within said cylindrical tube extending into said chamber for transporting said cuttings from said chamber rearwardly into said tube; and a cutting head carried forwardly of said housing for rotation about a central axis.

* * * * *